US010894334B2

(12) United States Patent
Knura et al.

(10) Patent No.: US 10,894,334 B2
(45) Date of Patent: Jan. 19, 2021

(54) SLICE-CUTTING MACHINE WITH TOOL-FREE, EXCHANGEABLE CUTTING FRAME

(71) Applicant: Bizerba SE & Co. KG, Balingen (DE)

(72) Inventors: Martin Knura, Lorch (DE); Stefan Heinzelmann, Hechingen (DE)

(73) Assignee: BIZERBA SE & CO. KG, Balingen (DE)

( * ) Notice: Subject to any disclaimer, the term of this patent is extended or adjusted under 35 U.S.C. 154(b) by 102 days.

(21) Appl. No.: 16/375,856

(22) Filed: Apr. 5, 2019

(65) Prior Publication Data

US 2020/0023538 A1 Jan. 23, 2020

(30) Foreign Application Priority Data

Jul. 18, 2018 (EP) ..... 18184131

(51) Int. Cl.
*B26D 1/153* (2006.01)
*B26D 7/00* (2006.01)
(Continued)

(52) U.S. Cl.
CPC ..... *B26D 7/0006* (2013.01); *B26D 1/153* (2013.01); *B26D 7/01* (2013.01); *B26D 7/32* (2013.01);
(Continued)

(58) Field of Classification Search
CPC ..... B26D 7/0006; B26D 1/153; B26D 7/01; B26D 7/32; B26D 7/0616; B26D 2210/02;
(Continued)

(56) References Cited

U.S. PATENT DOCUMENTS 2,984,176 A * 5/1961 Sommer ..... B21J 13/03 83/698.71
5,974,925 A * 11/1999 Lindee ..... B26D 1/0006 83/403.1
(Continued)

FOREIGN PATENT DOCUMENTS

DE 102013207744 A1 10/2014
DE 102013207830 A1 * 10/2014 ..... B26D 7/01
(Continued)

*Primary Examiner* — Kenneth E Peterson
*Assistant Examiner* — Liang Dong
(74) *Attorney, Agent, or Firm* — Leydig, Voit & Mayer Ltd.

(57) ABSTRACT

An electrically-operated slice-cutting machine for cutting slices off—in particular, strand-shaped—material to be cut—preferably, food—includes: a machine housing which holds a drive motor and a rotating and/or circumferentially-movable cutting blade driven by the drive motor; a product feed for feeding the material to be cut to the cutting blade; a carrier plate; and a cutting frame arranged on the carrier plate and via which the material to be cut is fed to the cutting blade. The cutting frame is geometrically arranged such that the material to be cut is feedable by the product feed through the cutting frame to the cutting blade in an operating state of the slice-cutting machine. The slice-cutting machine has at least a first and a second lever element for releasably fixing the cutting frame, each of the two lever elements being transferrable from a holding position into a release position.

14 Claims, 9 Drawing Sheets

(51) Int. Cl.
*B26D 7/01* (2006.01)
*B26D 7/32* (2006.01)
*B26D 7/06* (2006.01)

(52) U.S. Cl.
CPC ..... *B26D 7/0616* (2013.01); *B26D 2210/02* (2013.01)

(58) Field of Classification Search
CPC .. B26D 7/2614; B26D 7/0633; B26D 7/0683; Y10T 83/2192; Y10T 83/654; Y10T 83/0448; Y10T 83/0538; Y10T 83/657
USPC ..... 83/698.11–699.11, 932, 155, 42, 422, 83/409, 29
See application file for complete search history.

(56) References Cited

U.S. PATENT DOCUMENTS

| | | | | |
|---|---|---|---|---|
| 2012/0118119 | A1 | 5/2012 | Weber | |
| 2015/0266196 | A1* | 9/2015 | Mann | B26D 5/08 83/39 |
| 2016/0144527 | A1* | 5/2016 | Achenbach | B26D 7/06 83/13 |
| 2019/0232513 | A1* | 8/2019 | Erne | B26D 7/32 |

FOREIGN PATENT DOCUMENTS

| | | | |
|---|---|---|---|
| EP | 2153950 | A2 | 2/2010 |
| EP | 2424713 | A1 | 3/2012 |
| WO | WO 2010142378 | A1 | 12/2010 |

* cited by examiner

SLICE-CUTTING MACHINE WITH TOOL-FREE, EXCHANGEABLE CUTTING FRAME

CROSS-REFERENCE TO PRIOR APPLICATION

Priority is claimed to European Patent Application No. EP 18 184 131.3, filed on Jul. 18, 2018, the entire disclosure of which is hereby incorporated by reference herein.

FIELD

The invention relates to an electrically-operated slice-cutting machine for cutting slices off—in particular, strand-shaped—material to be cut—preferably, food—having a machine housing which holds a drive motor and a rotating and/or circumferentially-movable cutting blade driven by the drive motor, and having a product feed which feeds the material to be cut to the cutting blade, wherein the slice-cutting machine comprises a carrier plate and a cutting frame which is arranged thereon and via which the material to be cut is fed to the cutting blade.

BACKGROUND

EP 2 424 713 B1 discloses a slice-cutting machine with a product feed which feeds material to be cut to a cutting blade. The product feed has a closing element with a supporting surface for a product end region. The closing element is releasably fixed without screws on a carrier by means of a clamping device with exactly one fixing element.

Although the closing element can be released from the carrier and thus from the slice-cutting machine without tools, the clamping process requires the assembly of several abutting components in the form of the carrier, the fixing element, and the closing element. The clamping device is thus comparatively time-consuming to operate and susceptible to interference.

SUMMARY

In an embodiment, the present invention provides an electrically-operated slice-cutting machine for cutting slices off—in particular, strand-shaped—material to be cut—preferably, food—comprising: a machine housing which holds a drive motor and a rotating and/or circumferentially-movable cutting blade driven by the drive motor; a product feed configured to feed the material to be cut to the cutting blade; a carrier plate; and a cutting frame arranged on the carrier plate and via which the material to be cut is fed to the cutting blade, wherein the cutting frame is geometrically configured such that the material to be cut is feedable by the product feed through the cutting frame to the cutting blade in an operating state of the slice-cutting machine, wherein the slice-cutting machine has at least a first and a second lever element configured to releasably fix the cutting frame, each of the two lever elements being transferrable from a holding position into a release position by a movement mechanism, each of the two lever elements in the holding position abutting the cutting frame, wherein the cutting frame is fixable to the carrier plate by the lever elements in the holding position, wherein, in the release position, a respective lever element is spaced apart from the cutting frame, and wherein the cutting frame is releasable from the carrier plate without tools.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
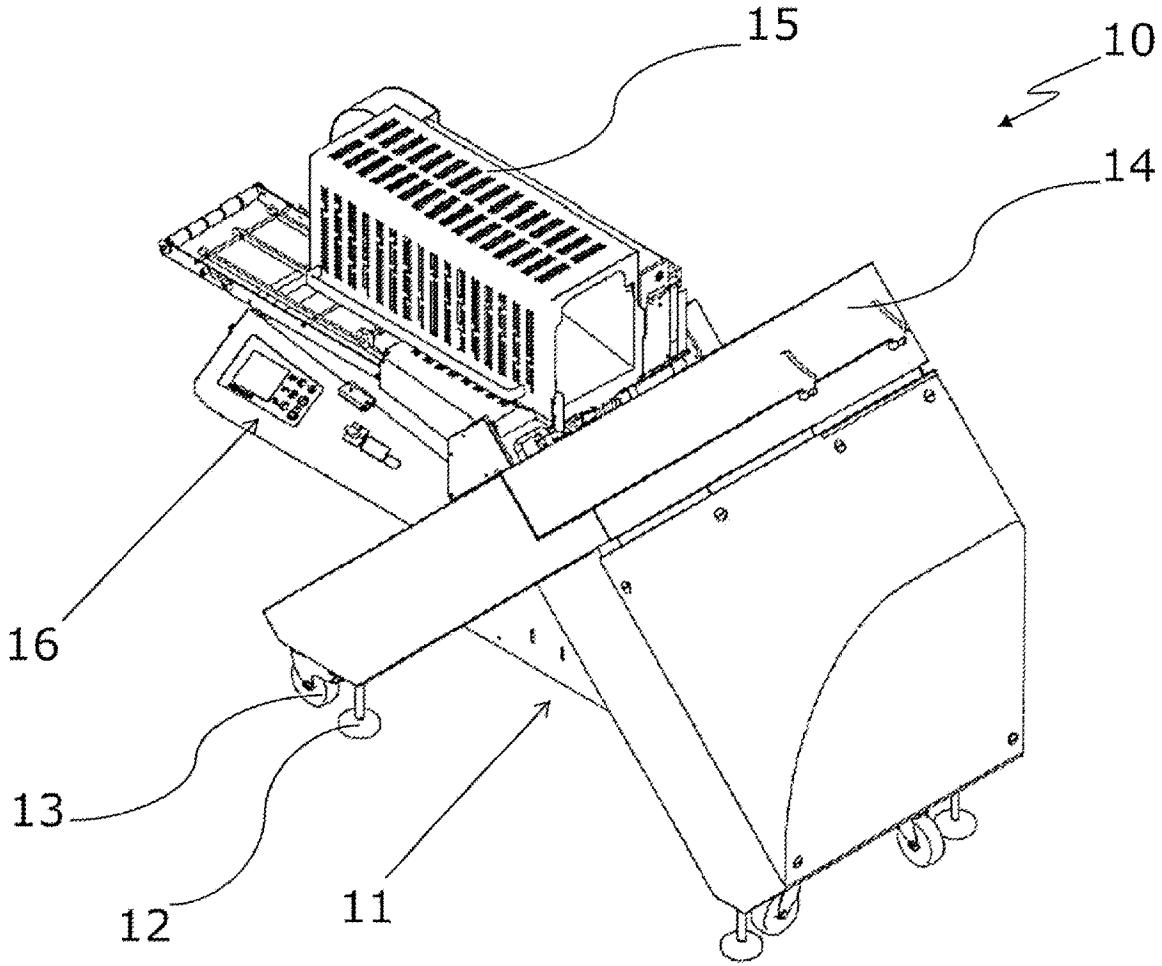
prior art FIG. 1
FIG. 1 an isometric view of a slice-cutting machine according to the prior art, with its housing.

By contrast, in an embodiment, the present invention provides a slice-cutting machine of the type defined at the outset in a cost-effective manner and with readily available technical means in a straightforward manner in such a way that a cutting frame of the slice-cutting machine is fixed on the carrier sheet both securely and so as to be quickly releasable without tools.

This aim is achieved with regard to the device in a technically particularly simple and surprisingly effective manner by a generic, electrically-operated slice-cutting machine which is wherein the cutting frame is geometrically designed in such a way that the material to be cut can be fed by the product feed through the cutting frame to the cutting blade in the operating state of the slice-cutting machine. The slice-cutting machine has at least a first and a second lever element for releasably fixing the cutting frame, wherein each of the two lever elements can be transferred from a holding position into a release position by a movement mechanism. In the holding position, each of the two lever elements abuts the cutting frame. The cutting frame can be fixed to the carrier plate by the lever elements in the holding position. In the release position, the respective lever element is spaced apart from the cutting frame, and the cutting frame can be released from the carrier plate without tools. The cutting frame is inserted into a through-hole of the carrier plate. The cutting blade can be designed as an orbital, rotating blade or as a sickle blade. When the cutting frame is fixed to the carrier plate by the lever elements in the holding position, this also includes the cases in which the cutting frame is fixed in or on the carrier plate.

In the slice-cutting machine according to the invention, the cutting frame is securely fixed to the carrier plate by the two lever elements in the holding position and can be released from the carrier plate and exchanged quickly, without material expenditure and without tools. This is particularly relevant in the case of wear of the cutting frame, if the cutting frame comes into even only very light contact with the rapidly rotating cutting blade during cutting operations, as can generally happen with high-performance slicers. On the one hand, the cutting frame supports the end of the material to be cut and, on the other, the blade moves past the cutting frame with each cut. The material to be cut passes through the cutting frame, and the blade strikes the material to be cut directly behind the cutting frame. The cutting frame is thus worn by the passing blade and is therefore a wearing part when considered in a longer time frame.

In a first, relatively simple embodiment of the invention, the movement mechanism has a pivot mechanism and/or a folding mechanism of the respective lever element. By means of such movement mechanisms, the lever elements can be quickly and easily moved from the holding position into the release position.

In a further, more comfortable embodiment, the cutting frame in connection with the carrier plate is self-centering, wherein, in particular, the cutting frame and the carrier plate have beveled surfaces abutting each other in a form-fitting manner. As a result, the cutting frame can be quickly and easily inserted into the carrier plate very precisely, with little tolerance.

In advantageous embodiments of the invention, the cutting frame is shaped so that it can be precisely positioned in the carrier plate, wherein the cutting frame, in particular, has a beveled corner. As a result, the cutting frame can be inserted quickly and easily into the carrier plate, without the correct alignment of the cutting frame having to be tried first.

A further preferred embodiment of the slice-cutting machine according to the invention is wherein at least one of the lever elements can be pivoted about a pivot point from the holding position into the release position. The pivot point can, in particular, be attached to the carrier plate. The lever elements are thereby mounted on the carrier plate. The lever elements can be attached to the carrier plate by nuts.

A class of likewise preferred embodiments of the slice-cutting machine is wherein the slice-cutting machine has at least one securing block, against which abuts at least one of the lever elements in the holding position, wherein the securing block is arranged in the direction of movement of the lever element from the holding position into the release position. The securing block fixes the lever element in the holding position and prevents an undesired transfer into the release position.

In an advantageous development of this embodiment, the securing block is attached to the machine housing—in particular, to a blade hood of the slice-cutting machine. When the lever elements are attached to the carrier plate opposite the blade hood, the securing blocks can be attached in fixed positions to the blade hood and simultaneously abut the lever elements in order to prevent a rotational movement of the lever elements from the holding position.

Alternatively or additionally, in other developments of this embodiment, at least one of the lever elements can have a tab which abuts the securing block in the holding position of the lever element. The securing block may abut the tab at the bottom in the vertical direction, in order to prevent a downward rotational movement of the lever element.

According to another preferred embodiment, the slice-cutting machine can be wherein the securing block, in the release position of the lever element, is movable against the tab of the lever element and thereby prevents the machine housing from closing, wherein, in particular, at least a part of the lever element with the tab is arranged in the release position at a position at which the securing block is located in the holding position of the lever element. In the attempt to close the machine housing when the lever elements are in the release position, the securing blocks abut the lever elements and, as a safety measure, prevent the housing from closing.

A further advantageous embodiment is wherein at least one of the lever elements is designed as a rocker with a support, and a spring is arranged on this lever element, wherein the spring can be tensioned by pivoting the lever element from the holding position. The spring holds the lever element in the holding position, and the lever element in turn fixes the cutting frame to the carrier plate.

In a preferred embodiment of the slice-cutting machine according to the invention, the cutting frame has a groove in which the lever elements engage in the holding position. By a groove in the cutting frame, an additional safeguard against unintentional movement of the lever element from the holding position into the release position can be effected.

According to a further advantageous embodiment, the slice-cutting machine can be wherein at least one of the lever elements is designed as a tensioning lever element. By means of a tensioning lever, a quick change from a stable holding position into a stable release position can be effected in a simple manner by turning down the lever element.

In further preferred embodiments, the slice-cutting machine according to the invention comprises a closure-monitoring sensor of the machine housing, wherein the machine can only be started when the machine housing is closed. Such a closure-monitoring sensor generates additional protection against injuries, since the slice-cutting machine thus cannot be inadvertently started. If the lever element is in the release position, the machine housing cannot be closed, and the closure-monitoring sensor prevents the slice-cutting machine from starting.

A further embodiment of the slice-cutting machine is wherein the cutting frame has a bevel, a stepped supporting surface for the lever elements, and/or a stepped contour for positioning on the carrier plate. By means of a bevel, a better feed-in of the material to be cut can be achieved, and/or jamming can be better prevented when pushing the levers onto the cutting frame. The lever elements can be positioned closer to the carrier plate by means of a stepped supporting surface. When a stepped positioning contour is used, the entire outside of the cutting frame need not be beveled for positioning the cutting frame.

In further embodiments of the slice-cutting machine, the carrier plate is rigidly connected—in particular, screwed—to the machine housing of the slice-cutting machine. The carrier plate can, in particular, be formed as part of the machine housing. Then, the carrier plate need not be mounted separately.

In preferred embodiments, the cutting frame and/or a through-opening of the cutting frame for the material to be cut is quadrangular. Uniformly receiving the material to be cut through the cutting frame with respect to height and width is thereby made possible.

A further embodiment of the slice-cutting machine according to the invention is wherein the carrier plate is designed as a carrier sheet. The use of sheet metal as material allows for a light and stable design of the carrier plate.

The slice-cutting machine according to a further embodiment may also have more than one securing block—in particular, one further one. Both securing levers can then respectively be fixed in their holding position by a separate securing block.

In the slice-cutting machine according to the invention, the product feed is generally designed as an automatic device—preferably, with an endless conveyor belt. By using an automatic product feed, the dwell time of the product during processing is shortened, and the entire cutting process is thus accelerated.

The advantages of the present invention are particularly apparent when the slice-cutting machine according to the invention is designed as a high-performance slicer. The fast exchangeability of the cutting frame according to the invention is particularly relevant to high-performance slicers in which the cutting frame is worn away quickly by the rapid rotation of the cutting blade even in case of very little contact with the cutting blade.

FIG. 1 shows an isometric view of a slice-cutting machine 10 according to the prior art, with its machine housing 11. The housing 11 is mounted on height-adjustable feet 12 and has rollers 13 mounted on the underside of the housing 11 for easier transport of the slice-cutting machine 10. Under a pivotable blade hood 14, the housing 11 holds a cutting blade as shown in FIGS. 2 and 3.

Via a product feed 15 mounted pivotably on the housing 11, material to be cut may be fed to the cutting blade in the slice-cutting machine 10. The pivotable mounting of the product feed 15 allows convenient loading of the slice-cutting machine 10 by folding down the product feed for loading with fresh material to be cut so that the product support extends substantially horizontally, and the product feed 15 is pivoted back upwards into a cutting position after the material to be cut is inserted. In particular, food rolls, such as sausage rolls or cheese rolls, are intended as material to be cut, from which individual slices are severed by the cutting blade.

A control device 16 arranged in the housing 11 controls the cutting operation. The control device 16 has a display for displaying data and a keyboard for inputting data.

Figure 2:
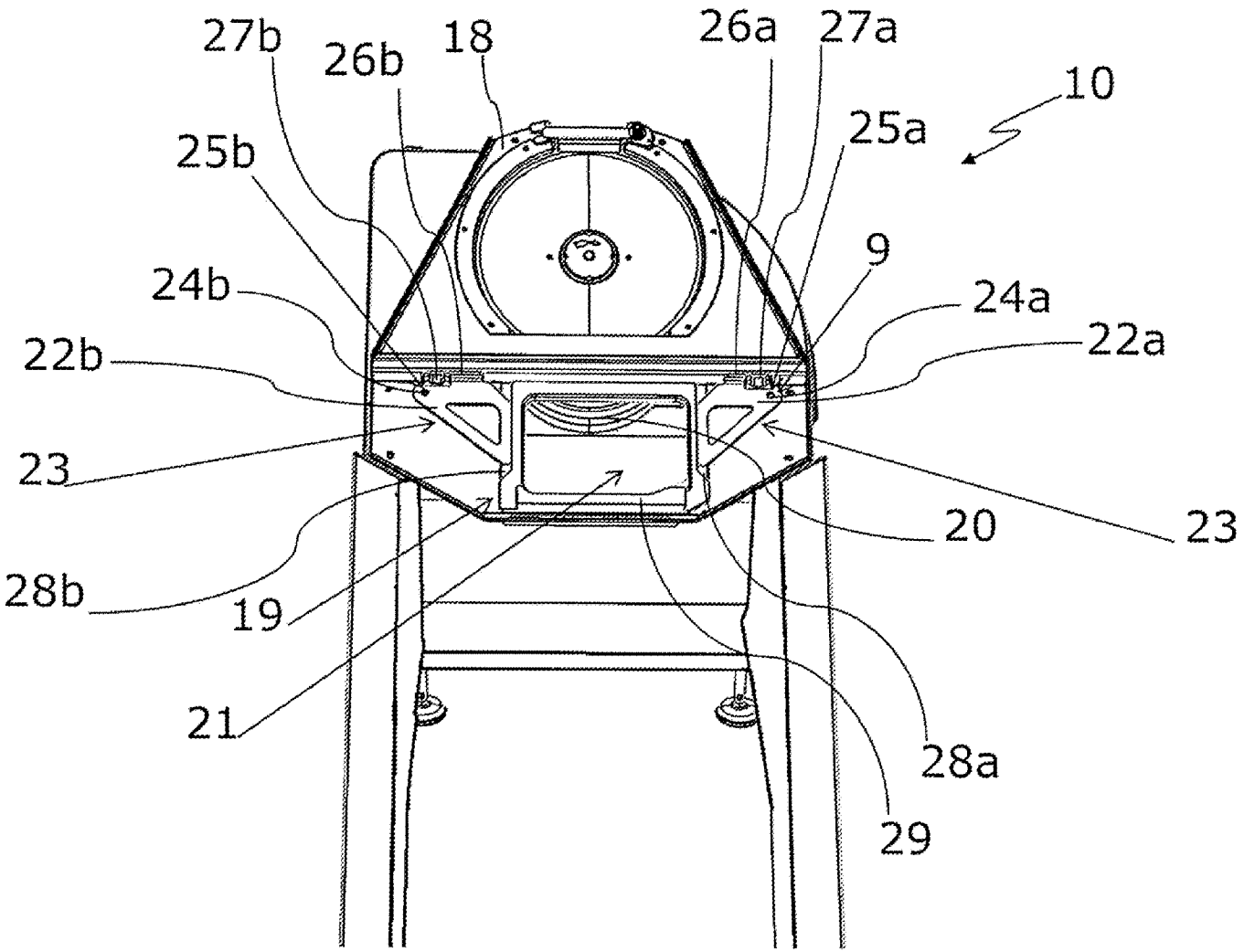
FIG. 2 a schematic front view of a slice-cutting machine according to the invention, without product feed and without blade hood.
Figure 3:
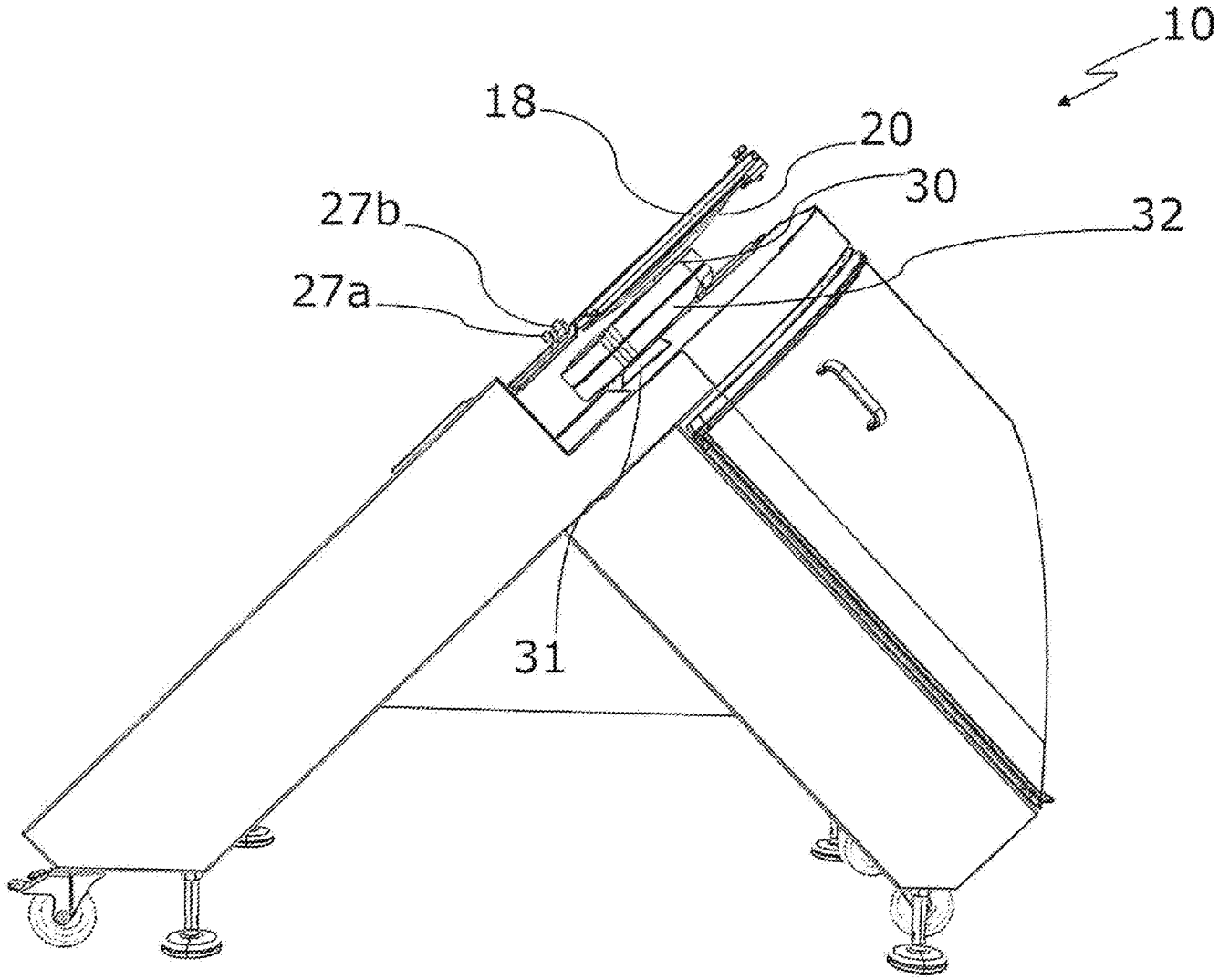
FIG. 3 a lateral view of the embodiment according to FIG. 2.

FIG. 2 shows a front view of a slice-cutting machine 10 according to the invention, without the product feed 15 and without the blade hood 14 (see FIG. 1, however). A cutting frame 19 is located in a carrier plate 18. In the transport direction of the material to be cut behind the carrier plate 18 and the cutting frame 19, an orbital rotating cutting blade 20 is arranged, to which material to be cut can be fed through the quadrangular opening 21 of the cutting frame 19. A first and a second lever element 22*a*, 22*b* lie opposite each other in a holding position 23 against the cutting frame 19. The lever elements 22*a*, 22*b* fix the cutting frame 19 to the carrier plate 18.

Figure 7:
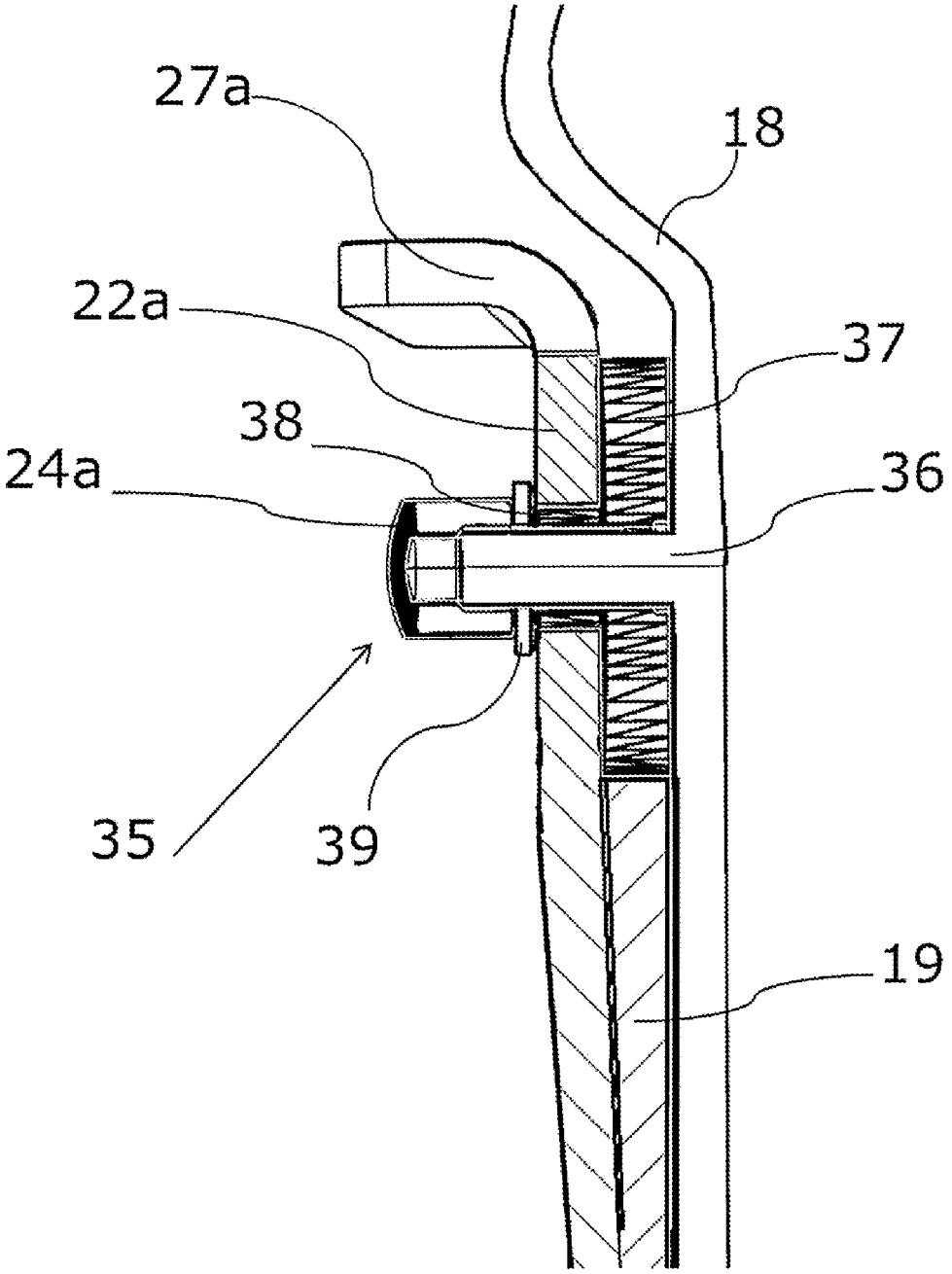
FIG. 7 an enlarged cross-section through the holder of one of the two lever elements.

The two lever elements 22*a*, 22*b* are fixed pivotably about a respective lever element pivot point 25*a*, 25*b* to the carrier plate 18 by means of nuts 24*a*, 24*b* as parts of a pivot bearing (see FIG. 7). The nuts 24*a*, 24*b* and lever element pivot points form parts of a movement mechanism 9 for pivoting the lever elements 22*a*, 22*b*. Securing blocks 27*a*, 27*b* abut tabs 26*a*, 26*b* of the lever elements 22*a*, 22*b* in the direction of rotation of the lever elements 22*a*, 22*b*. The securing blocks 27*a*, 27*b* prevent a rotation of the lever elements 22*a*, 22*b* from the holding position 23. The securing blocks 27*a*, 27*b* are, in particular, attached to the blade hood 14 (see FIG. 1).

The cutting frame 19 has a stepped supporting surface 28*a*, 28*b* each for the lever elements 22*a*, 22*b*. A conveying projection 29 of the cutting frame 19 serves as an intermediate piece of the further transport of the material to be cut by the product feed 15 to the cutting blade 20.

FIG. 3 shows a side view of the slice-cutting machine 10 without the product feed 15 and without the blade hood 14 (see FIG. 1). The lever elements 22*a*, 22*b* (see FIG. 2) are attached to the carrier plate 18 by nuts 24*a*, 24*b*. Behind the carrier plate 18, the cutting blade 20 is in a waiting position in which it is completely covered by the carrier plate 18. This prevents inadvertent injuries. The cutting blade 20 is mounted rotatably and eccentrically at a cutting blade pivot point 30 on a blade arm 32 which can be rotated about a blade arm pivot point 31. During cutting, the cutting blade 20 moves on a circular path and rotates about its own axis.

Figure 4:
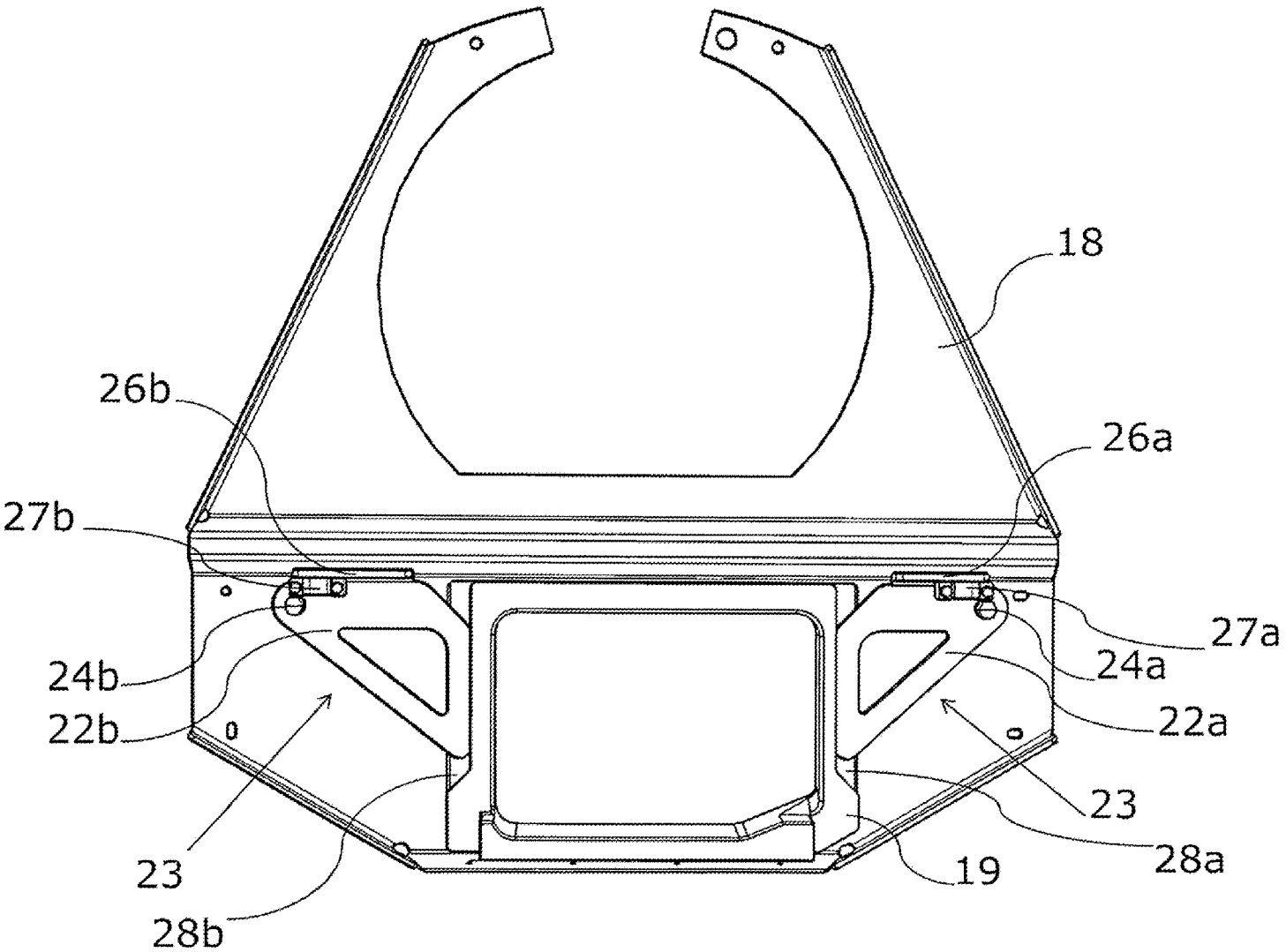
FIG. 4 a front view of the carrier plate of the slice-cutting machine according to the invention, with a cutting frame inserted in the carrier plate and two lever elements in the holding position fixed by nuts to the carrier plate.

FIG. 4 shows a front view of the carrier plate 18 with the cutting frame 19 inserted in the carrier plate and the lever elements 22*a*, 22*b* fixed to the carrier plate 18 by the nuts 24*a*, 24*b*. In the holding position 23, the lever elements 22*a*, 22*b* rest on the supporting surfaces 28*a*, 28*b* of the cutting frame 19. The securing blocks 27*a*, 27*b* which abut the tabs 26*a*, 26*b* of the lever elements 22*a*, 22*b* and prevent a rotational movement of the lever elements 22*a*, 22*b* from the holding position 23 are also shown.

Figure 5:
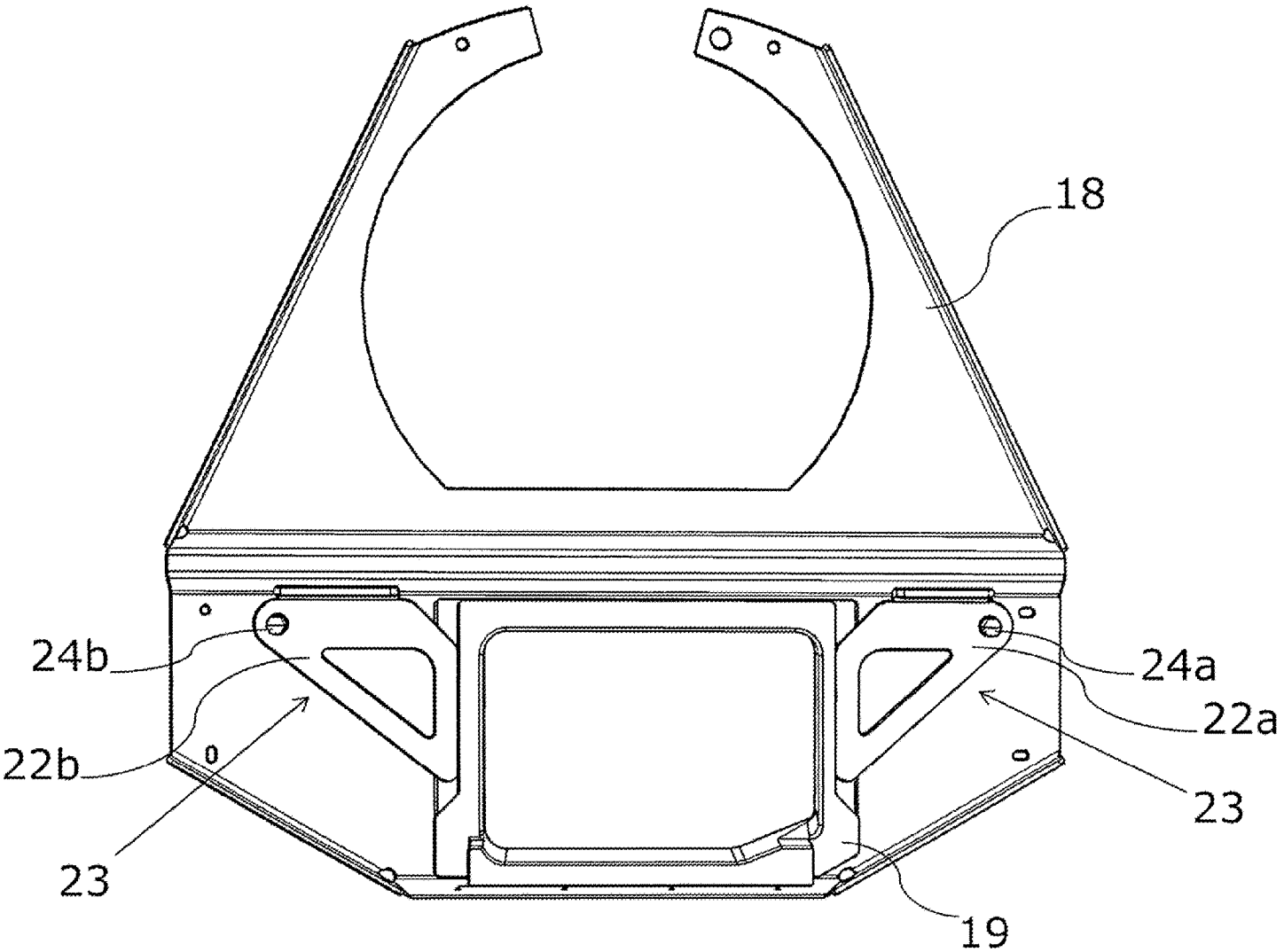
FIG. 5 an embodiment as in FIG. 4, but without securing blocks.

FIG. 5 shows a front view of the carrier plate 18 with the cutting frame 19 inserted in the carrier plate 18 and the lever elements 22*a*, 22*b*, fixed to the carrier plate 19 by the nuts 24*a*, 24*b*, without the securing blocks 27*a*, 27*b* (see FIG. 4). After removing the securing blocks 27*a*, 27*b*, the lever elements 22*a*, 22*b* can be pivoted out of the holding position 23 in which they abut the cutting frame 19. Since the securing blocks 27*a*, 27*b* are fixed to the blade hood 14, they are removed from the tabs 26*a*, 26*b* of the lever elements 22*a*, 22*b* when opening the blade hood 14.

Figure 6:
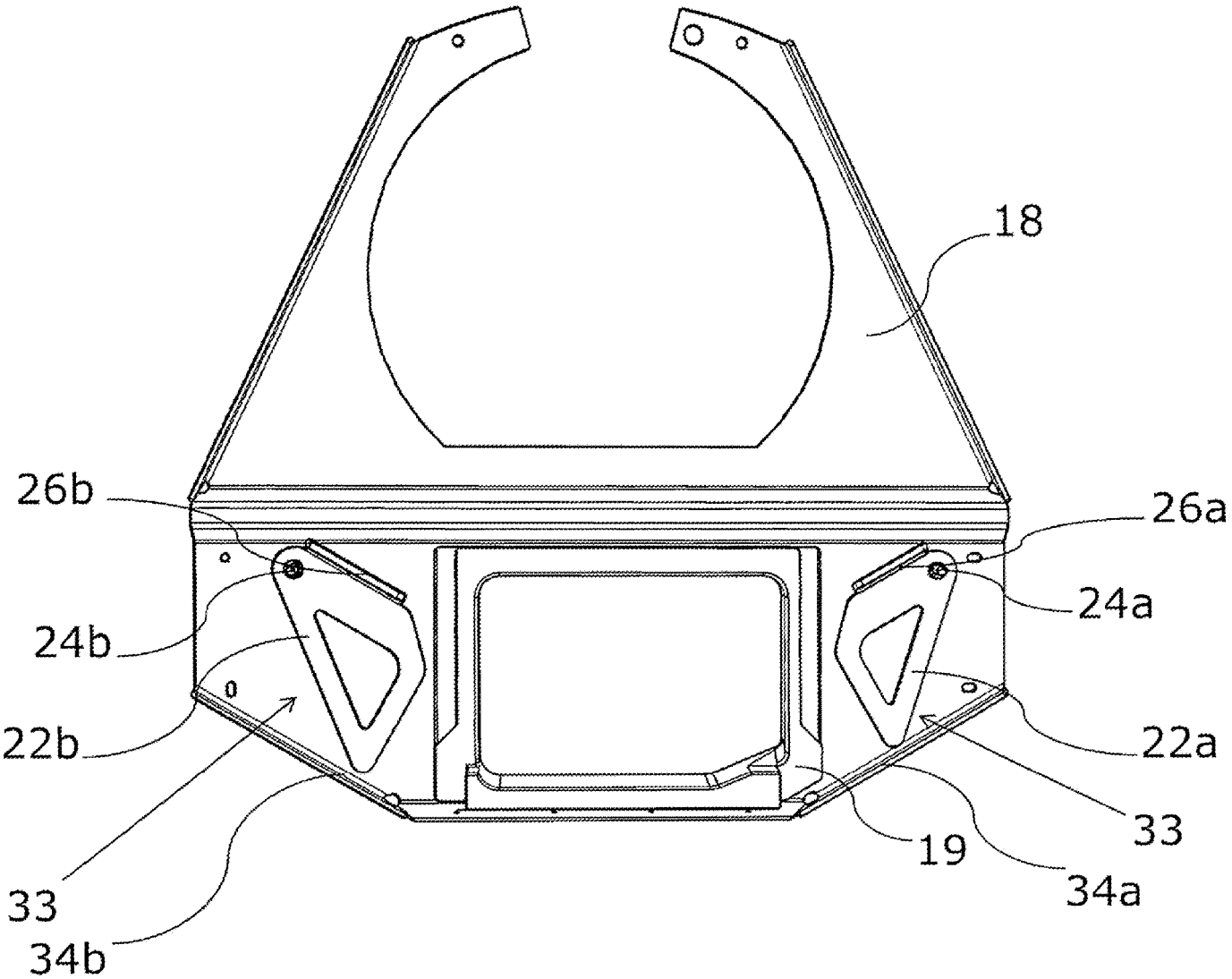
FIG. 6 the embodiment of FIG. 5 with cutting frame inserted in the carrier plate and lever elements in the release position fixed by nuts.

FIG. 6 shows a front view of the carrier plate 18 with the cutting frame 19 inserted in the carrier plate 18 and the lever elements 22*a*, 22*b*, fixed to the carrier plate 18 by the nuts 24*a*, 24*b*, in a release position 33. The lever elements 22*a*, 22*b* assume the release position 33 by a rotation from the holding position 23 (see FIG. 4) after the securing blocks 27*a*, 27*b* (see FIG. 4) were removed by opening the blade hood 14. In the release position 33, the lever elements 22*a*, 22*b* no longer abut the cutting frame 19, but rest on the lever supporting surfaces 34*a*, 34*b* of the carrier plate 18. The tabs 26*a*, 26*b* are located in a region in which, in the holding position 23, the securing blocks 27*a*, 27*b* (see FIG. 4) were positioned. The lever elements 22*a*, 22*b* can only assume the release position 33 if the blade hood 14 (see FIG. 1) and the securing blocks 27*a*, 27*b* attached to the blade hood 14 are removed. In the release position 33 of the lever elements 22*a*, 22*b*, the tabs 26*a*, 26*b* prevent the blade hood 14 from being attached, since the securing blocks 27*a*, 27*b* are moved against the tabs 26*a*, 26*b* and prevent a correct positioning of the securing blocks 27*a*, 27*b* attached to the blade hood 14.

FIG. 7 shows a cross-section through a holder 35, designed as a pivot bearing, of a lever element 22*a*. A pin 36 is attached—in particular, by welding—to the carrier plate 18. A cylindrical slider 37 with a lever receptacle 38 is mounted around the pin 36. The lever element 22*a* with the tab 27*a* is positioned on the slider 37 around the lever receptacle 38. The lever element 22*a* is fixed on the slider 37 by the nut 24*a*. Located between the nut 24*a* and the lever element 22*a* is a washer 39 for protection against wear. The cutting frame 19 against which the lever element 22*a* abuts is shown in cross-section.

Figure 8:
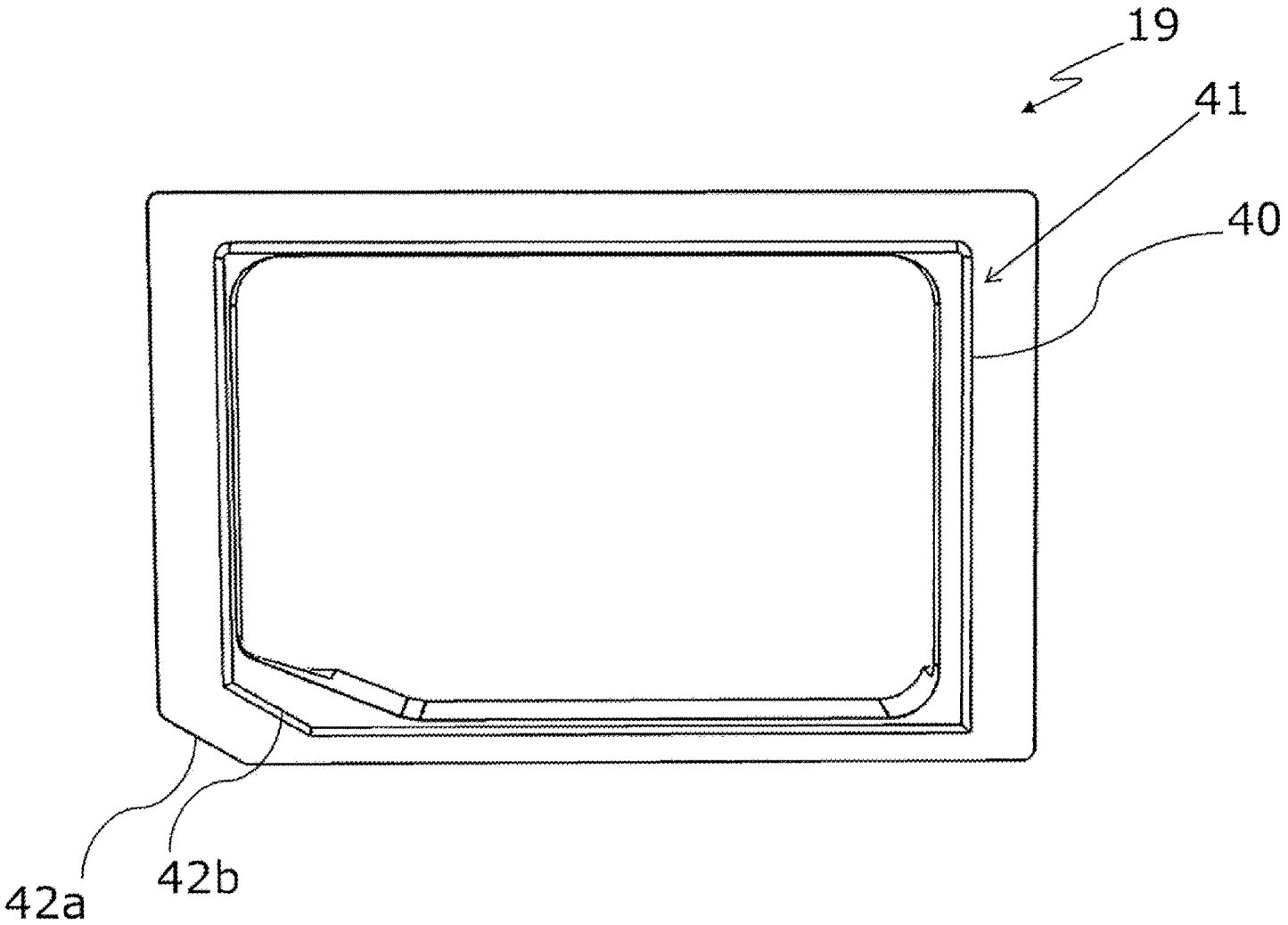
FIG. 8 a schematic rear view of a quadrangular cutting frame.

FIG. 8 shows a rear view of the quadrangular cutting frame 19 with respect to the transport direction of the material to be cut. The side, facing the cutting blade 20 (see FIG. 2), of the cutting frame 19 is thus shown. The cutting frame 19 has a contour 40 with beveled side surfaces 41 by means of which centering is brought about when the cutting frame 19 is inserted into the carrier plate 18 (see FIG. 2). For this purpose, the carrier plate 18 can, in particular, have a through-hole with side surfaces which positively abut the beveled side surfaces 40 of the cutting frame 19. For precise positioning of the cutting frame 19 in the carrier plate 18, one of the corners likewise has bevels 42*a*, 42*b*.

Figure 9:
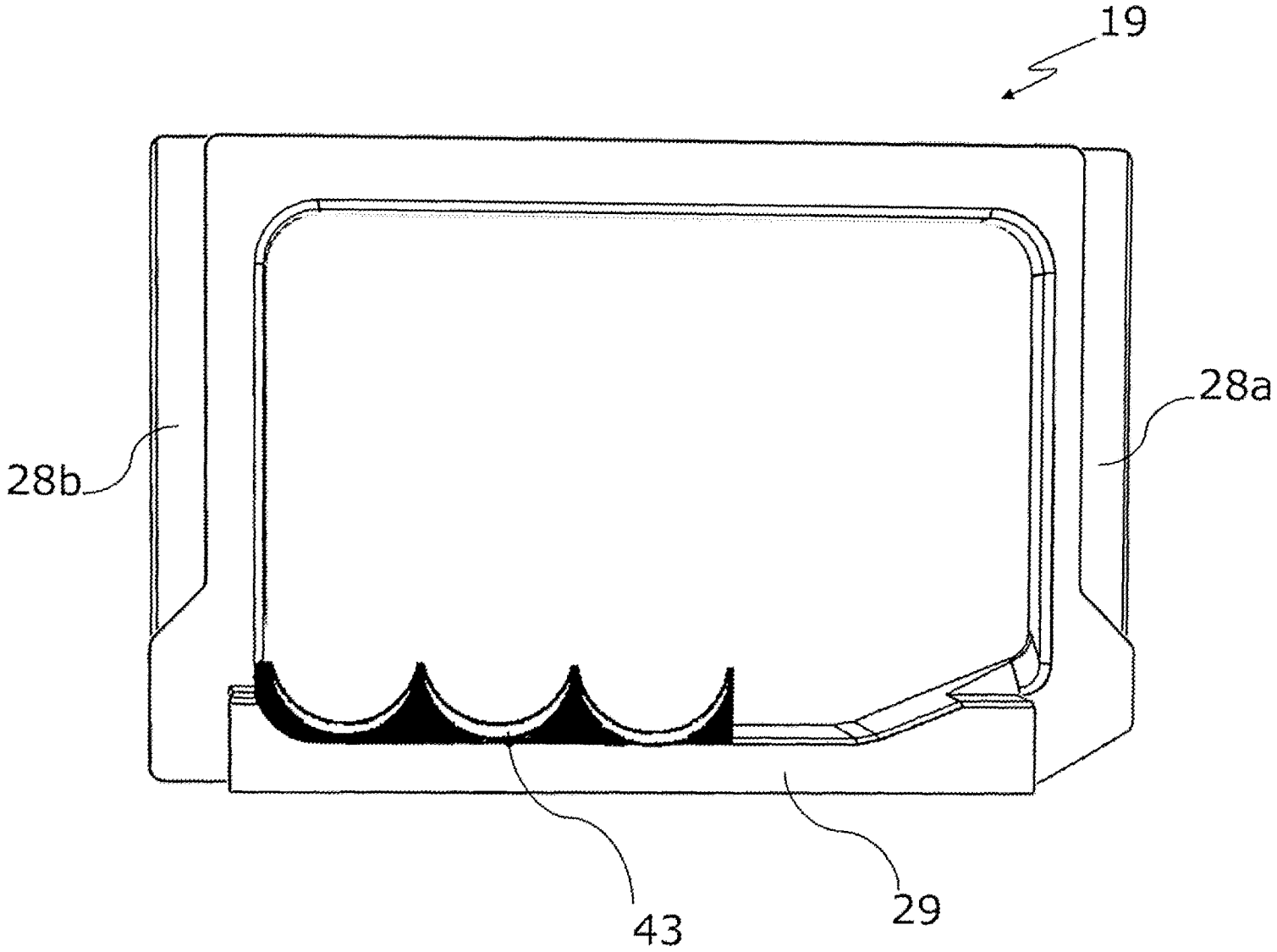
FIG. 9 a front view of the cutting frame, with groove-shaped attachment.

FIG. 9 shows a front view of the cutting frame 19. The stepped supporting surfaces 28*a*, 28*b* for the lever elements 22*a*, 22*b* (see FIG. 2) are shown. The conveying projection 29 of the cutting frame 19 has a groove-shaped attachment 43 for separating the material to be cut into blocks guided in parallel.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMBERS

9 Movement mechanism
10 Slice-cutting machine
11 Housing
12 Height-adjustable feet
13 Rollers
14 Blade hood
15 Product feed
16 Control device
18 Carrier plate
19 Cutting frame
20 Cutting blade
21 Quadrangular opening
22*a, b* First and second lever elements
23 Holding position
24*a, b* Nuts
25*a, b* Lever element pivot points
26*a, b* Tabs
27*a, b* Securing blocks
28*a, b* Stepped supporting surface
29 Conveying projection
30 Cutting blade pivot point
31 Blade arm pivot point
32 Blade arm
33 Release position
34*a, b* Lever supporting surfaces
35 Holder
36 Pin
37 Cylindrical slider
38 Lever receptacle
39 Washer
40 Contour
41 Beveled surfaces
42 Corner
43 Groove-shaped attachment

What is claimed is:

1. An electrically-operated slice-cutting machine for cutting slices off material to be cut, the slice-cutting machine comprising:

a machine housing which holds a drive motor and a rotating and/or circumferentially-movable cutting blade driven by the drive motor;

a product feed configured to feed the material to be cut to the cutting blade;

a carrier plate; and a cutting frame arranged on the carrier plate and via which the material to be cut is fed to the cutting blade, wherein the cutting frame is geometrically configured such that the material to be cut is feedable by the product feed through the cutting frame to the cutting blade in an operating state of the slice-cutting machine, wherein the slice-cutting machine has at least a first and a second lever element configured to releasably fix the cutting frame, each of the two lever elements being transferrable from a holding position into a release position by a movement mechanism, each of the two lever elements in the holding position abutting the cutting frame, wherein the cutting frame is fixable to the carrier plate by the lever elements in the holding position, wherein, in the release position, the first and second lever element are spaced apart from the cutting frame, and wherein the cutting frame is releasable from the carrier plate without tools, wherein the cutting frame in connection with the carrier plate is self-centering, and wherein the cutting frame and the carrier plate have beveled surfaces abutting each other in a form-fitting manner.

2. The slice-cutting machine according to claim 1, wherein the movement mechanism has a pivot mechanism and/or a folding mechanism of each of the first and second lever element.

3. The slice-cutting machine according to claim 1, wherein at least one of the lever elements is pivotable about a pivot point from the holding position into the release position.

4. The slice-cutting machine according to claim 1, further comprising at least one securing block which at least one of the lever elements in the holding position abuts, wherein the securing block is arranged in a movement direction of the lever element from the holding position into the release position.

5. The slice-cutting machine according to claim 4, wherein the securing block is attached to a blade hood of the slice-cutting machine.

6. The slice-cutting machine according to claim 4, wherein at least one of the lever elements has a tab which abuts the securing block in the holding position of the lever element.

7. The slice-cutting machine according to claim 6, wherein the securing block, in the release position of the lever element, is movable against the tab of the lever element and thereby prevents closing of the machine housing, and wherein at least a part of the lever element with the tab is arranged in the release position at a position at which the securing block is located in the holding position of the lever element.

8. The slice-cutting machine according to claim 1, wherein at least one of the lever elements comprises a rocker with a support, and a spring is arranged on the at least one of the lever elements, and wherein the spring is tensionable by pivoting the lever element from the holding position.

9. The slice-cutting machine according to claim 1, wherein the cutting frame has a groove in which the lever elements engage in the holding position.

10. The slice-cutting machine according to claim 1, wherein at least one of the lever elements comprises a tensioning lever element.

11. The slice-cutting machine according to claim 1, wherein the machine housing has a closure-monitoring sensor, and wherein the slice-cutting machine is startable only when the machine housing is closed.

12. The slice-cutting machine according to claim 1, wherein the cutting frame has a bevel, a stepped supporting surface for the lever elements, and/or a stepped contour for positioning on the carrier plate.

13. The slice-cutting machine according to claim 1, wherein the carrier plate is rigidly connected and screwed to the machine housing.

14. An electrically-operated slice-cutting machine for cutting slices off material to be cut, the slice-cutting machine comprising:

a machine housing which holds a drive motor and a rotating and/or circumferentially-movable cutting blade driven by the drive motor;

a product feed configured to feed the material to be cut to the cutting blade;

a carrier plate; and a cutting frame arranged on the carrier plate and via which the material to be cut is fed to the cutting blade, wherein the cutting frame is geometrically configured such that the material to be cut is feedable by the product feed through the cutting frame to the cutting blade in an operating state of the slice-cutting machine, wherein the slice-cutting machine has at least a first and a second lever element configured to releasably fix the cutting frame, each of the two lever elements being transferrable from a holding position into a release position by a movement mechanism, each of the two lever elements in the holding position abutting the cutting frame, wherein the cutting frame is fixable to the carrier plate by the lever elements in the holding position, wherein, in the release position, the first and second lever element are spaced apart from the cutting frame, and wherein the cutting frame is releasable from the carrier plate without tools, wherein the cutting frame is shaped to be precisely positioned in the carrier plate, and wherein the cutting frame has a beveled corner.

* * * * *